US006375311B1

(12) United States Patent
Kuramoto

(10) Patent No.: US 6,375,311 B1
(45) Date of Patent: Apr. 23, 2002

(54) IMAGE FORMING APPARATUS AND IMAGE FORMING METHOD USING AN EXTRUSION OPENING AND SHUTTER FOR RELEASING RECORDING SOLUTION

(75) Inventor: Shinichi Kuramoto, Nakai-machi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/184,286

(22) Filed: Nov. 2, 1998

(30) Foreign Application Priority Data

Nov. 7, 1997 (JP) ..... 9-305303

(51) Int. Cl.[7] ..... B41J 2/04
(52) U.S. Cl. ..... 347/54
(58) Field of Search ..... 347/68, 69, 70, 347/71, 72, 50, 40, 55, 20, 27, 74; 399/261; 361/700; 29/890.1; 310/328–330; 396/493, 505, 213

(56) References Cited

FOREIGN PATENT DOCUMENTS

| | | | | |
|---|---|---|---|---|
| JP | A-64-63185 | 3/1989 | | |
| JP | A-2-307753 | 12/1990 | | |
| JP | A-4-257485 | 9/1992 | | |
| JP | A-5-8384 | 1/1993 | | |
| WO | WO 94/18011 | * 8/1994 | | 347/55 |

* cited by examiner

*Primary Examiner*—Raquel Yvette Gordon
(74) *Attorney, Agent, or Firm*—Oliff & Berridge, PLC

(57) ABSTRACT

The recording solution in a recording solution chamber is always pressurized. The shutter is closed when recording is not conducted to prevent the recording solution from flowing out and drying up. The shutter is opened by the shutter driving section in accordance with the image information during recording to open the extrusion opening. The recording solution is extruded from the extrusion opening by the pressurizing force. After the top end of the extruded recording solution is deposited to the opposed image support, the shutter driving section closes the shutter. This discontinues the recording solution flown so far continuously from the extrusion of opening to form a not-stringing recording droplet on the image support. Recording solutions having viscosity in a wide range can be used. The recording dots can be formed accurately with low energy, and high quality images with reduced blot of recording dots can be obtained at high speed.

16 Claims, 11 Drawing Sheets

IMAGE FORMING APPARATUS AND IMAGE FORMING METHOD USING AN EXTRUSION OPENING AND SHUTTER FOR RELEASING RECORDING SOLUTION

BACKGROUND OF THE INVENTION

1. Field of the Invention

The present invention concerns an image forming apparatus for forming images by depositing a recording solution to an image support and an image forming method.

2. Related Art

Various proposals have been made so far for an image forming apparatus of a so-called ink jet system of applying an energy to a recording solution thereby forming and flying minute liquid droplets and depositing the droplets on an image support. The image forming apparatus of the ink jet system includes a scanning type using one or a plurality of nozzles on every color and scanning an image support to conduct recording or an array type using a plurality of nozzles arranged as an array. A mechanism of flying a recording solution used in the ink jet system is, for example, adapted to exert an external force such as pulse pressure on a recording solution in a cavity thereby jetting out particles of the recording solution from a nozzle. The pulse pressure is formed by pressure of air bubbles due to deformation of a piezoelectric transducer or heating and boiling of a recording solution.

In the existent ink jet system described above, since the recording solution has to be caused to fly by the pressure of air bubbles due to the heating of the recording solution or the deformation of the piezoelectric transducer, a recording solution of low viscosity at about 1–3 mPa·s is used. However, this involves the following basic problems. Namely, when recording is applied to common paper or like other paper sheet by using the recording solution at such a low viscosity, feathering occurs in which the recording solution blots a paper sheet along fibers of paper when the recording solution hits on the paper sheet, or the shape of dots to be printed is larger compared with a nozzle diameter and made uneven. Further, when recording is applied by using recording solutions of different colors, color mixing occurs to result in bleeding upon contact of dots adjacent to each other.

An approach for solving such problems has been disclosed, for example, in Japanese Published Unexamined Patent Application No. Sho 64-63185. FIG. 13 is an explanatory view of an existent recording method in one example of an image forming apparatus of an ink jet system for reducing blot. In the drawing are shown a pre-depositing solution head 41, a recording solution head 42, an image support 43, a pre-depositing recording droplet 44, and a recording droplet 45. At first, as shown in FIG. 13(A), a pre-depositing droplet 44 is caused to fly by using a pre-depositing solution head 41 to hit on the image support 43. The pre-depositing solution is a solution for insolubilizing the recording solution. In FIG. 13(B), a recording droplet 45 is caused to fly from the recording solution head 42 and the recording solution hits on the previously hit pre-depositing solution. Thus, both of the solutions are mixed as shown in FIG. 13(C) and the recording solution is insolubilized to be prevented from blotting the inside of the paper sheet. However, the blot preventing is still insufficient even in this method, as well as the pre-depositing solution used for the insolubilization of the recording solution is hit previously, so that secondary trouble is caused that the paper sheet itself is creased due to the pre-depositing solution.

The foregoing is problems resulting, particularly, in a case of using a recording solution of low viscosity. The problems may be solved basically by the use of a recording solution increased with viscosity. However, in the ink jet system of flying the recording solution by the pressure of air bubbles due to the deformation of a piezoelectric transducer or heating of the recording solution as described above, it was impossible to fly the recording solution of high viscosity or it required a great amount of energy for flying the droplets. Therefore, a system different from such an ink jet system has been developed.

In one of typical systems, a recording solution is formulated into special hot melt type. In this system, a recording solution which is solid at a normal temperature is used, and the viscosity of the recording solution near the nozzle of a recording head is usually lowered by heating, and a recording solution is jetted in a stringing manner. However, the viscosity of the recording solution usable for this system is limited to about 10 mPa·s. Further, there is also a problem of requiring heat energy for always heating the recording solution.

Another method capable of using a recording solution of high viscosity is disclosed, for example, in Japanese Published Unexamined Patent Application No. Hei 5-8384, in which a plurality of individual curved ink channels are formed as an array each at a predetermined interval in the inside of a polarizing body comprising a piezoelectric material, and individual electrodes and a common electrode are formed to partition walls of the individual ink channels and a voltage is applied to the electrodes, thereby causing a large displacement to the partition walls in the direction of the array. This increases a volume of adjacent individual ink channels in which the recording solution is filled and, subsequently, the recording solution in the recording solution chamber of increased volume is jetted out by the reaction caused upon returning of the displaced recording solution walls. The literature describes that the ink of high viscosity can be used but gives no detailed descriptions. Based on the content disclosed in the literature, it is considered that even if the displacement caused by the piezoelectric member is greatly increased by a curved shape, vibrations due to the resultant displacement are absorbed into the recording solution per se at a viscosity higher than 10 mPa·s and it is impossible to jet the solution. In addition, since the volume of the adjacent individual ink channels is also changed by the displacement of the partition walls, the amount of the recording solution is changed due to the change of the volume or the hitting position of the droplet is scattered to possibly deteriorate the quality of recorded images.

A further method capable of using a recording solution of high viscosity includes a method of printing a recording solution of high viscosity by depositing a recording solution to an image support without flying as described, for example, in Japanese Published Unexamined Application No. Hei 4-257485. FIG. 14 is a schematic cross sectional view illustrating an example of an existent image forming apparatus adapted to deposit a recording solution. In the drawing are shown a recording head 51, an ink chamber 52, an electric field application electrode 53, and an image support 54. The recording head 51 has the ink chamber 52 for storing an ink and a discharge port formed at a portion in contact with the image support 54 for communication with the ink chamber 52. An electric field application electrode 53 is disposed to the discharge port. An electric field is applied depending on an image signal to the electric field application electrode 53 to control the amount of the recording solution discharged from the discharge port. The usable viscosity of the ink ranges from 50 to 1000 mPa·s.

FIG. 15 is a view for explaining a disadvantage in one example of the existent image forming apparatus adapted to deposit a recording solution during recording. In FIG. 15 (A), an electric field applied to the electric field application electrode 53 is controlled to deposit the ink on the image support 54. Subsequently, when the image support 54 or the recording head 51 is moved relatively for forming a succeeding picture element, the ink cannot be discontinued merely by shearing force accompanying the relative movement but it inevitably causes a stringing state of ink as shown in FIG. 15(B). Further, since the recording head 51 is in direct contact with the image support 54, there is a problem that the ink deposited on the image support 54 is frictionally rubbed by the top end of the discharge port. In such a case, even if an ink of high viscosity is used, the image quality cannot be improved. Further, since only the ink having an electric viscosity can be used, the material of the ink is limited to an extremely narrow range. Furthermore, since the flow of the ink is controlled by an electric viscosity effect, it involves a fundamental problem that the discharged amount of the ink cannot be controlled if a power source for the apparatus main body is discontinued to possibly leak the ink from the discharge port.

OBJECT OF THE INVENTION

The present invention has been achieved in view of the foregoing situations and it is an object thereof to provide an image forming apparatus and an image forming method capable of using a recording solution of a viscosity within a wide range, capable of forming a recording dot at high accuracy with a low energy and capable of obtaining high quality images of recording dots with reduced blot at high speed.

SUMMARY OF THE INVENTION

The foregoing object of the present invention can be attained by an image forming apparatus comprising a recording solution chamber for possessing a recording solution, a pressurizing unit for pressurizing a recording solution in the recording solution chamber, an extrusion opening disposed to the recording solution chamber, a shutter disposed to the extrusion opening and a shutter driving device for driving to open and close the shutter in accordance with image information.

In the present invention, recording is conducted by extruding a recording solution from an extrusion opening and depositing the solution on an image support. A shutter is disposed to the extrusion opening and the extrusion opening is opened only upon recording a dot. Further, after extrusion of the recording solution, the shutter is closed to stop the extrusion of the recording solution. Control for the extrusion amount of the recording solution is enabled by the provision of the shutter to the extrusion opening and drying up of the recording solution can be prevented by closing the extrusion opening with the shutter in a period of time not requiring discharge of the recording solution during printing or in a period of time in which the image forming apparatus is caused to stand-by. In the present invention, since the recording solution is not caused to fly but extrude and flow out continuously, the energy required for recording can be reduced even for a recording solution of high viscosity compared with a case of flying recording droplets. Therefore, it is possible to extend the range for the usable viscosity of the recording solution and form images with a low energy. Particularly, since the recording solution of high viscosity can be used, blot of the recording dot can be prevented, thereby capable of preventing feathering or bleeding.

Further, in a case of using a recording solution of high viscosity, the recording solution extruded out of the extrusion opening is continuous. Therefore, if the image support, for example, is relatively moved as it is, the recording solution causes stringing to form a long tail to the dot recorded on the image support. In the present invention, however, since the stringing of the recording solution can be discontinued by closing the shutter, degradation of the image quality caused by stringing can be prevented.

Furthermore, since the recording solution is pressurized, the time from the opening of the shutter to the extrusion of the recording solution through the extrusion opening and deposition of the recording solution on the image support is extremely shortened to enable high speed recording.

BRIEF DESCRIPTION OF THE ACCOMPANYING DRAWINGS

Figure 6:
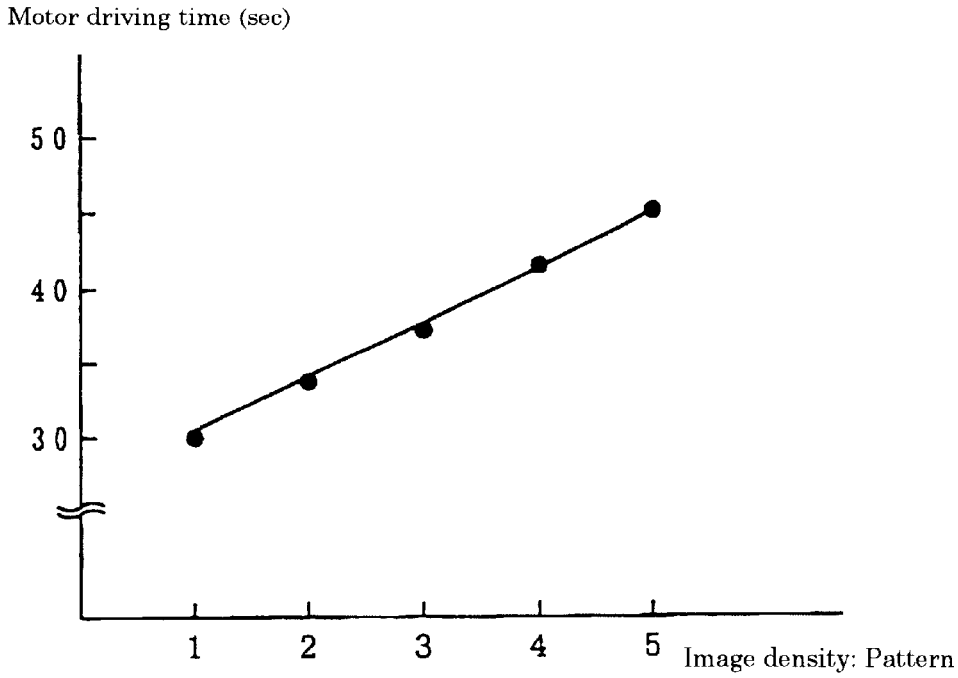
Figure 7:
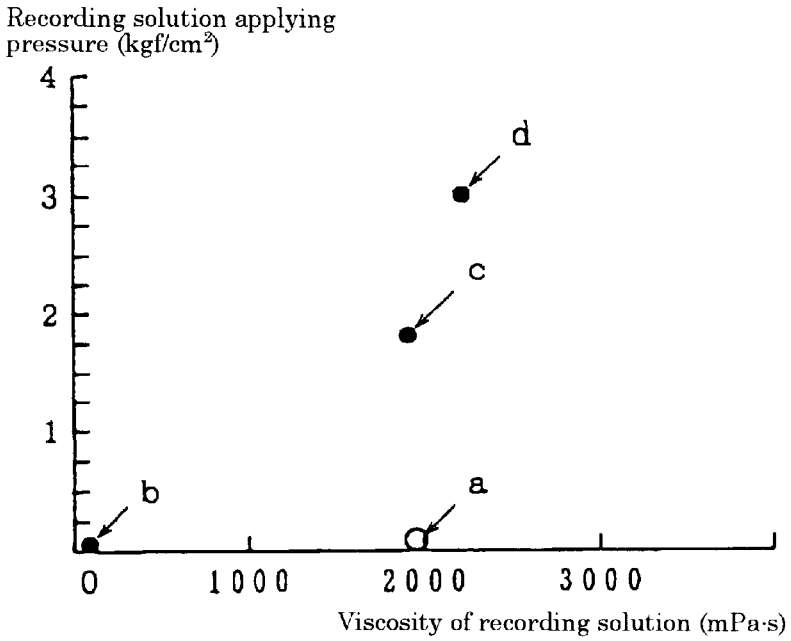
Figure 8A:
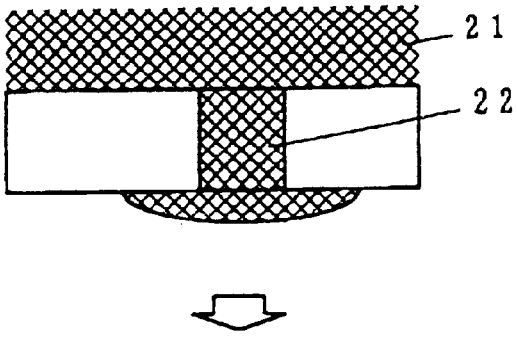
Figure 8B:
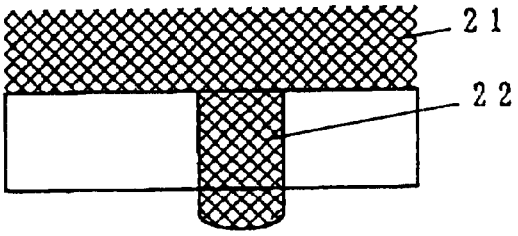
Figure 9A:
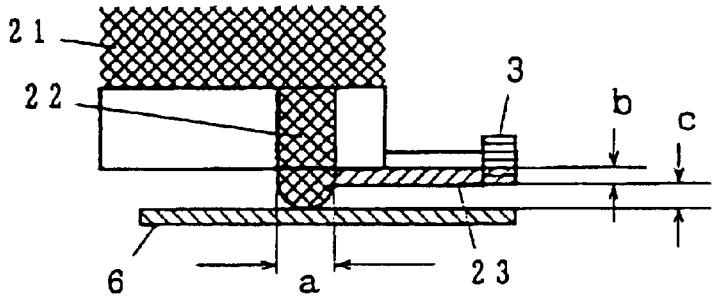
Figure 9B:
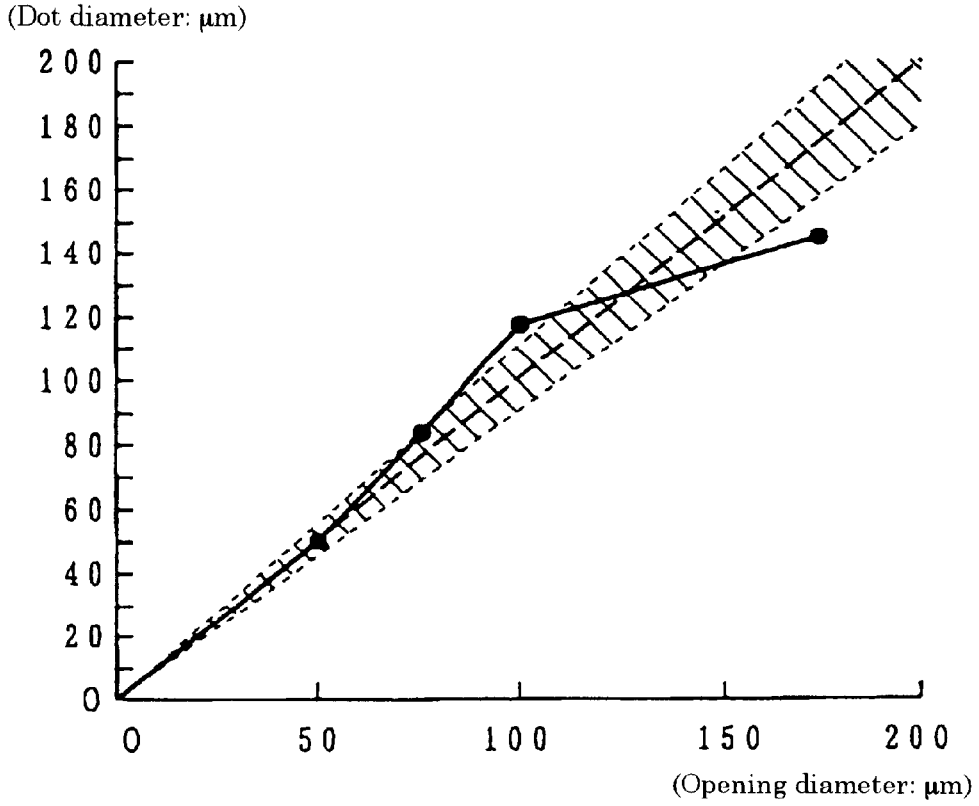
Figure 10:
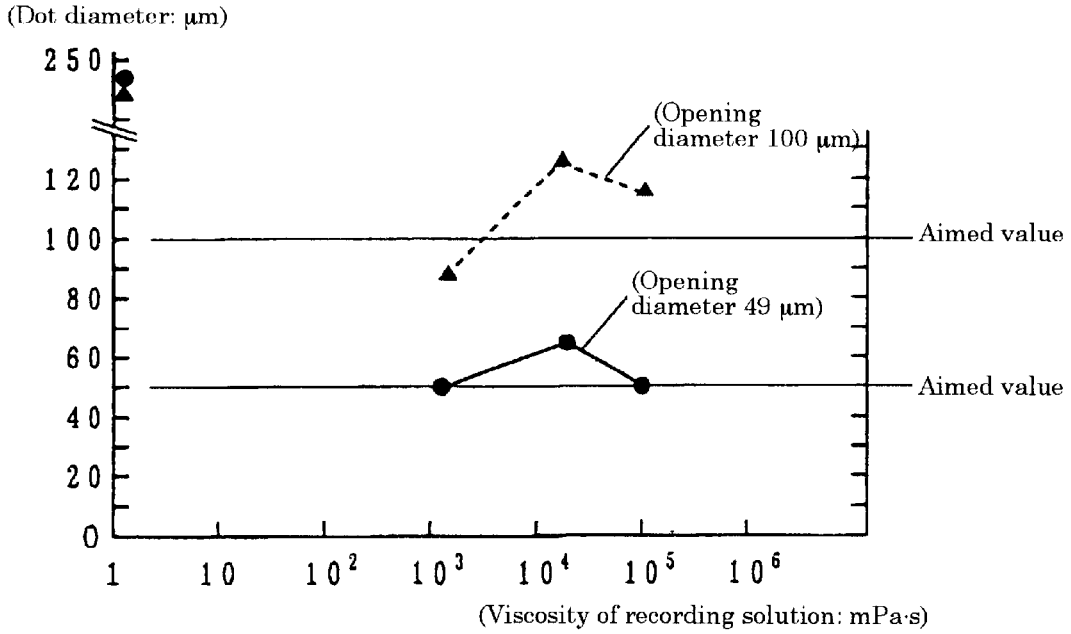
Figure 11A:
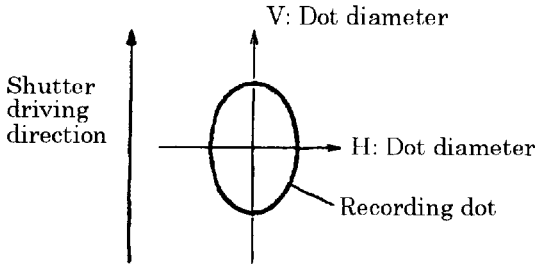
Figure 11B:
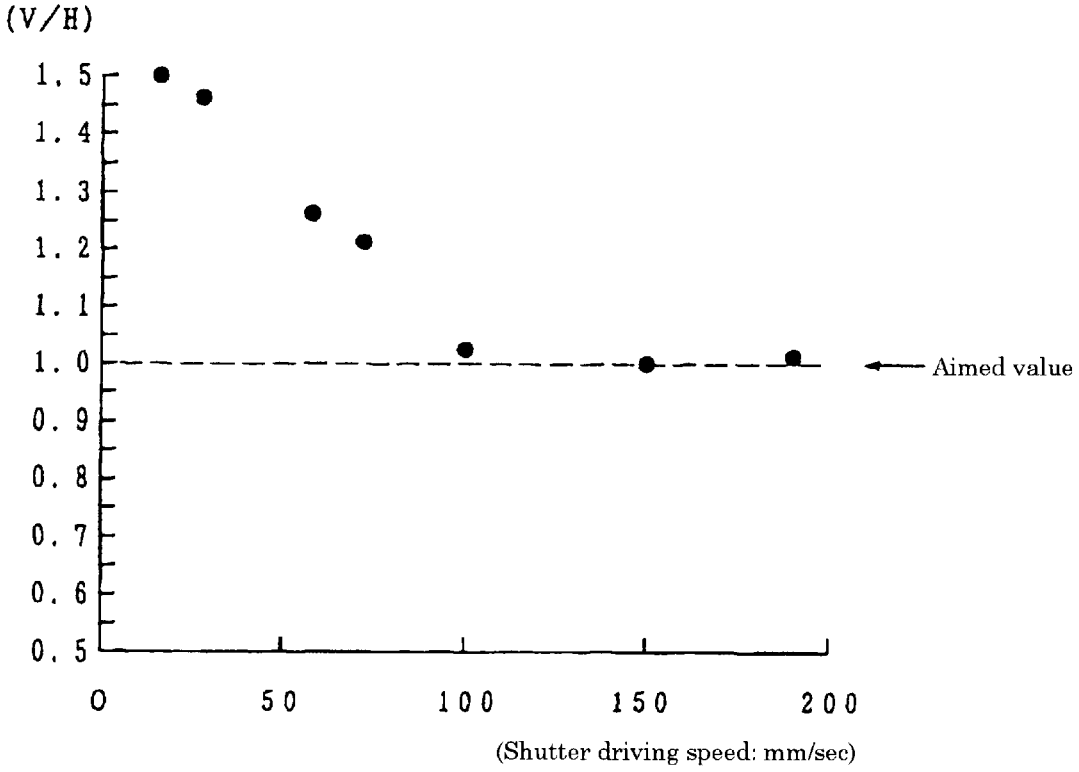
Figure 12A:
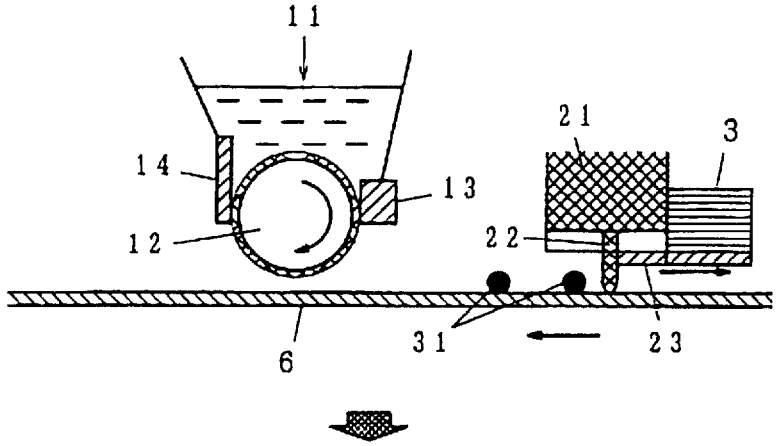
Figure 12B:
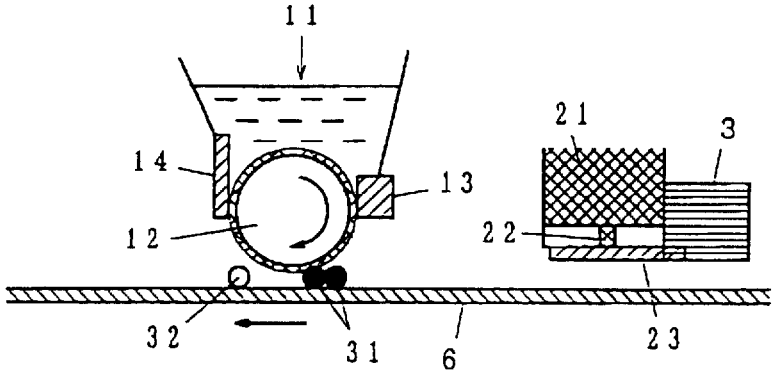
Figure 12C:
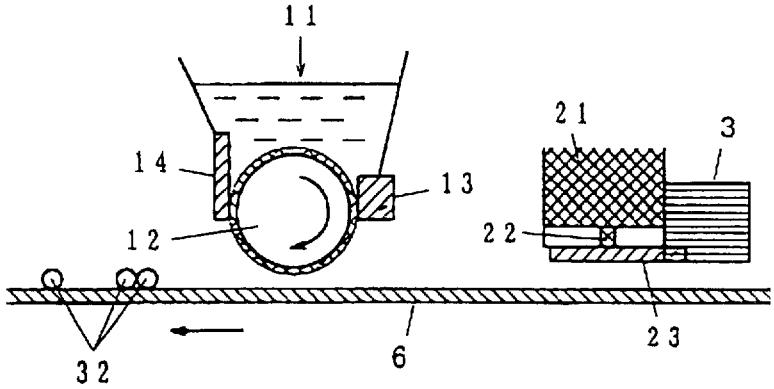
Figure 13A:
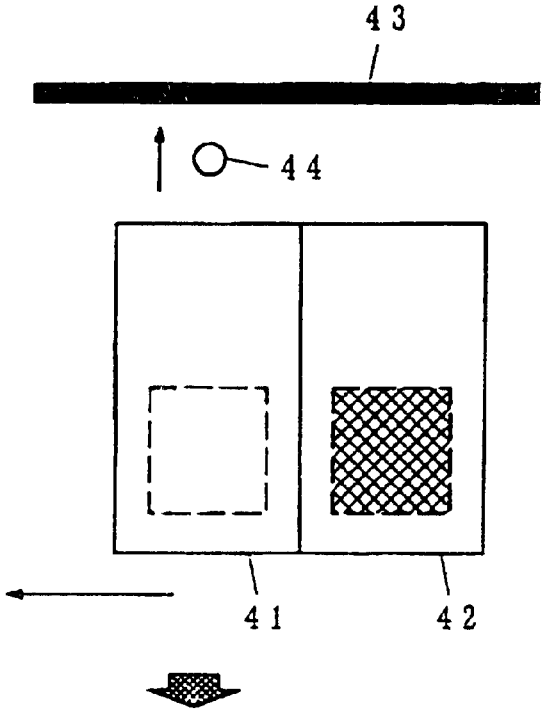
Figure 13B:
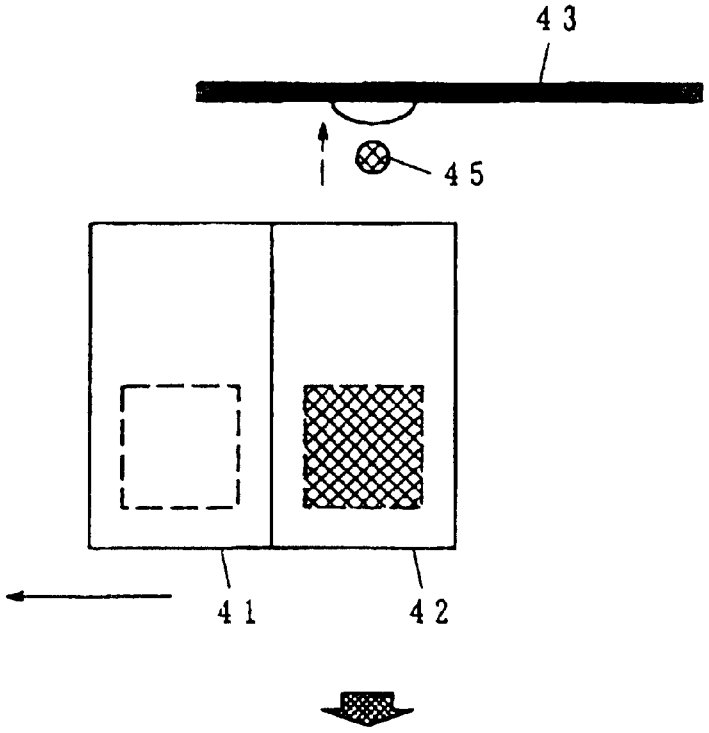
Figure 13C:
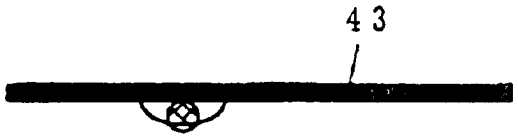
Figure 14:
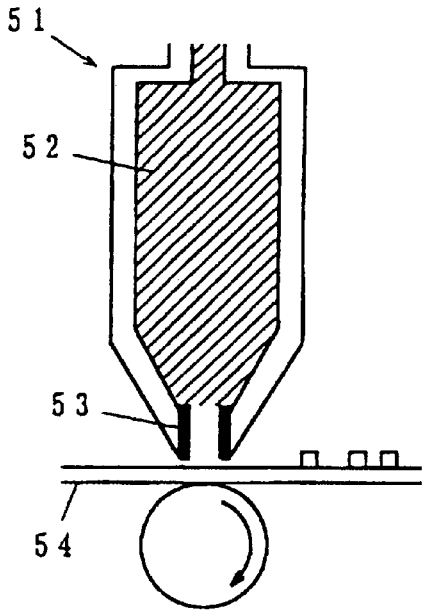
Figure 15A:
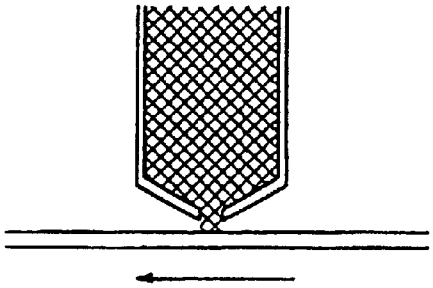
Figure 15B:
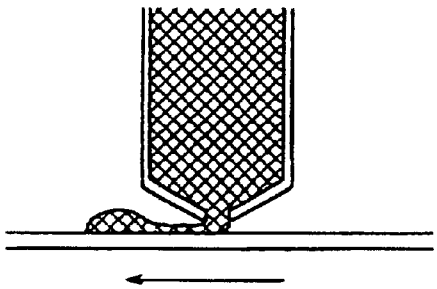

FIGS. 5(A)–(D) are schematic views illustrating an example of an operation upon forming a dot in the embodiment of the image forming apparatus according to the present invention;

FIG. 6 is a graph illustrating an example of a relationship between a pattern of an image density to be printed and a motor driving time;

FIG. 7 is a graph illustrating an example of a relationship between a viscosity of a recording solution and a required pressure;

FIGS. 8(A)–(B) are explanatory views caused by wetting in the vicinity of an extrusion opening 22;

FIG. 9(A) is a view of the extrusion opening showing the bore diameter measurement;

FIG. 9(B) is a graph illustrating an example of a relationship between an opening diameter of the extrusion opening and a dot diameter formed on an image support;

FIG. 10 is a graph illustrating an example of a relationship between a viscosity of a recording solution to be used and a dot diameter to be formed;

FIGS. 11(A)–(B) are explanatory views for an example of a relationship between a shutter driving speed and an aspect ratio of a dot diameter recorded;

FIGS. 12(A)–(C) are explanatory views for an example of a fixing process of a recording droplet in a fixing mechanism;

FIGS. 13(A)–(C) are explanatory views for an existent recording method in an example of a ink jet system in an image recording apparatus with reduced ink blot;

FIG. 14 is a schematic cross sectional view illustrating one example of an existent image forming apparatus of a recording solution deposition type;

FIGS. 15(A)–(B) are explanatory views for disadvantage during recording in the example of the existent image forming apparatus of recording solution deposition type.

PREFERRED EMBODIMENT OF THE INVENTION

Figure 1:
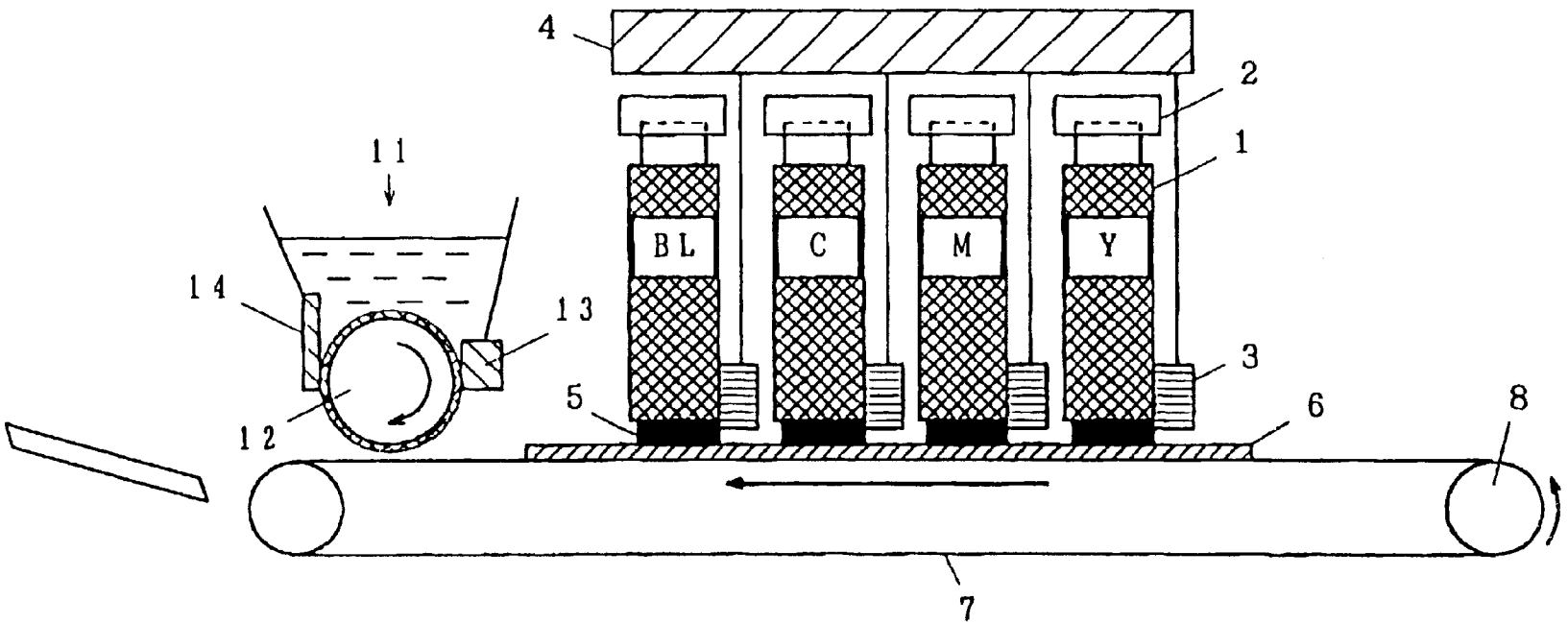
FIG. 1 is a schematic constitutional view illustrating an embodiment of an image forming apparatus according to the present invention.
Figure 2:
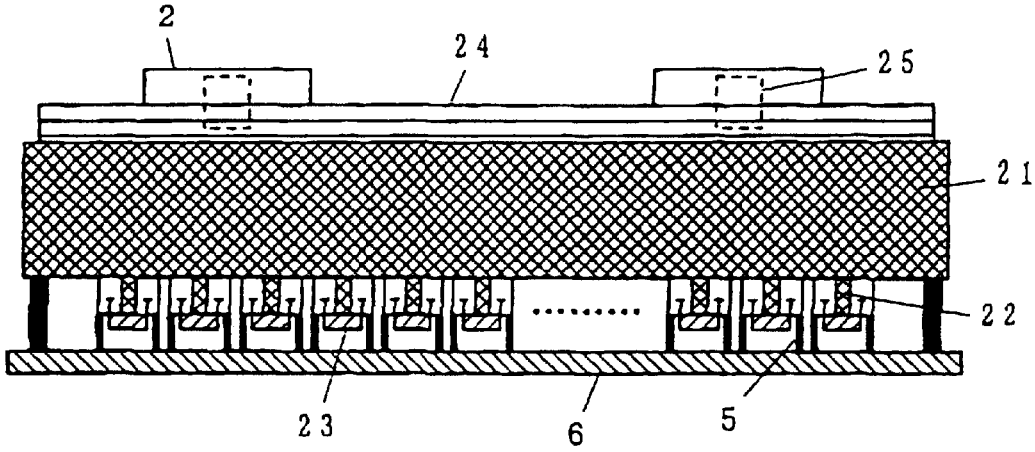
FIG. 2 is a cross sectional view of a recording head in the embodiment of the image forming apparatus according to the present invention.
Figure 3:
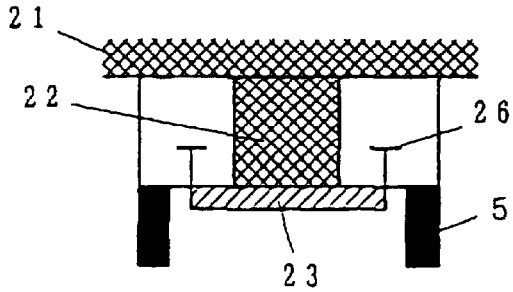
FIG. 3 is an enlarged cross sectional view of a recording head in the embodiment of the image forming apparatus according to the present invention.
Figure 4:
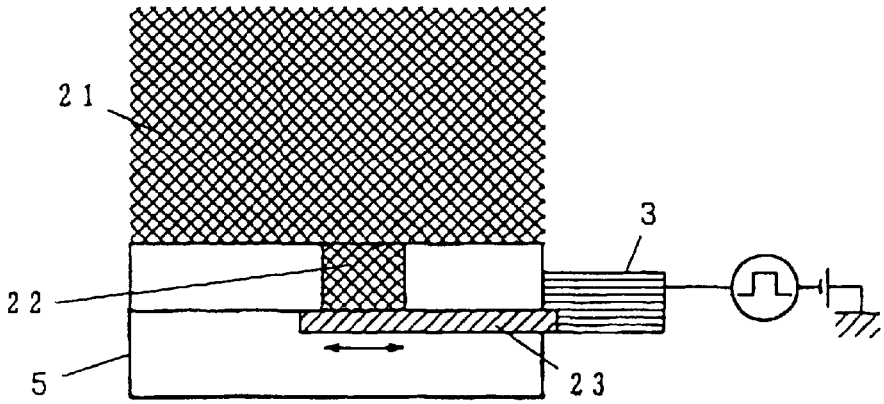
FIG. 4 is a cross sectional view along another direction of the recording head in the embodiment of the image forming apparatus according to the present invention.

FIG. 1 is a schematic constitutional view illustrating one embodiment of an image forming apparatus according to the present invention, FIG. 2 is a cross sectional view of a recording head of the apparatus, FIG. 3 is an enlarged cross sectional view of FIG. 2, and FIG. 4 is an enlarged cross sectional view in a direction perpendicular to FIG. 3. In the drawings are shown a recording head 1, a pressurizing section 2, a shutter driving section 3, a control section 4, a spacer 5, an image support 6, a conveyor belt 7, a belt conveyor roll 8, a solidifying solution tank 11, a solidifying solution application roll 12, a solidifying solution thickness control blade 13, a solidifying solution scraping member 14, a recording solution chamber 21, an extrusion opening 22, a shutter 23, a pressurizing member 24, a shaft 25, and guide rails 26.

The embodiment shown in FIG. 1 shows an image forming apparatus for forming color images and has four recording heads 1 corresponding to recording solutions for four colors. As an example, recording is conducted by depositing an yellow recording solution from a recording head Y, a magenta recording solution from a recording head M, a cyan recording solution from a recording head C and a black recording solution from a recording head BL, respectively, to the image support 6. The colors of the recording solutions used are not limited only to them but they may be five or more colors or three or less colors, as well as may be only a single color. In addition, a recording solution of an identical color but of different properties may be used for the entire or a part of colors. Further, in the embodiment shown in FIG. 1, a mechanism for coating solidifying solution and promoting fixing after forming the images with the recording solution is additionally disposed.

As shown in FIG. 2, the recording head 1 is provided with a tightly closed recording solution chamber 21 in which a recording solution is charged under pressure previously in a vacuum state. For pressurizing the inside of the recording solution chamber 1, the recording head is constituted with a material such as a glass particle-containing reinforced plastic or aluminum having reduced weight and strength compatible with each other so that no pressure deformation from the inside or the outside is caused. As the recording solution, those having a viscosity within a range from about 10 mPa·s to 1000 pa ·s (=1000000 mPa·s) can be used. The recording solution contained in each of the recording heads 1 contains at least one colorant so as to develop each of the colors.

For keeping the pressure in the recording solution chamber 21 along with consumption of the recording solution, the recording solution in the recording solution chamber 21 is pressurized by the pressurizing member 24. The shaft 25 is driven linearly by the rotation of the motor 2, and the pressurizing member 24 pressurizes the recording solution. This makes it possible to securely extrude the recording solution of high viscosity. Basically, it may suffice to reliably pressurize the recording solution of high viscosity in the recording solution chamber 21, and other various methods can be used, for example, such that the recording solution chamber 21 is made deformable as a tube structure, in which the tube is rolled-up while squeezing the rear end thereof to the extrusion opening 22.

The extrusion opening 22 is disposed for flowing out the recording solution in the recording solution chamber 21, at the top end of the recording head 1. In this case, when a recording solution of high viscosity is used as a recording solution as described above, it is important to decrease the tube wall resistance as much as possible. Therefore, as shown in FIG. 3 and FIG. 4, the cross sectional area of the extrusion opening 22 (in a recording solution supply channel from the recording solution chamber 21 to the opening end) is made uniform and the distance is made as short as possible. Thus, the recording solution is pressurized with a large cross sectional area until it reaches the extrusion opening 22, and the flow resistance is increased only for a short distance for the extrusion opening 22. Therefore, the pressure of supplying the recording solution may be low.

In this embodiment, as shown in FIG. 2, a plurality of extrusion openings 22 are disposed to one recording head 1 and a recording solution is supplied from a common recording solution chamber 21. A plurality of extrusion openings 22 may be arranged optionally such as substantially linearly or in a zigzag pattern. For example, 3008 of extrusion openings 22 can be disposed each at an interval of 70.5 $\mu$m (density of arrangement: 360 dpi). The printable width in this case is 212 mm.

The shutter 23 is disposed to the extrusion opening 22. The shutter 23 is driven by the shutter driving section 3 and caused to slide along the guide rails 26 as shown in FIG. 3. When the recording is not conducted, the shutter 23 closes the extrusion opening 22 to prevent drying up of the solution. During recording, the shutter opens the extrusion opening 22 to flow out the recording solution, while it closes the opening at a predetermined timing to discontinue the recording solution under flowing. This can prevent stringing of the recording solution. The shutter driving section 3 is constituted, for example, with a piezoelectric element or a linear motor and drives the shutter 23 linearly.

The control section 4 intakes image information, and controls the shutter driving section 3 in accordance with the image information to drive the shutter 23. Further, the control section controls the motor 2 in accordance with the consumption of the recording solution to adjust the pressurizing force in the recording solution chamber 21 by the pressurizing member 24.

In the embodiment shown in FIG. 1, the image support 6 is fed in accordance with the conveyor belt 7 driven by the belt conveyor roll 8. Any of materials can be used for the image support 6 such as paper, cloth, plastic, leather and metal plate so long as the material is a recording medium to which the recording solution can be applied. Alternatively, the conveyor belt 7 may be constituted as an intermediate transfer body that serves also as the image support 6 for transferring images formed on the conveyor belt 7 by each of the recording heads 1 to the recording medium. Instead of moving the image support 6, it may be constituted such that the recording head is moved or both of the members are moved in the directions opposite to each other.

A spacer 5 is disposed to each of the recording heads 1 for keeping a small gap relative to the image support 6. The spacer 5 is disposed such that the extrusion opening 22 and the image support 6 opposing to the extrusion opening 22 are set at a predetermined distance. The spacer 5 is disposed in parallel with the direction of conveying the image support 6. With such a constitution, the top end of the extrusion opening 22 can be kept from directly rubbing a printed dot and the shutter 23 can be prevented from rubbing the dot upon driving. In an elongate recording head 1 having a plurality of extrusion openings 22, shown in FIG. 2, spacers 5 are disposed on both ends of the shutter 23 disposed to each extrusion opening 22 for making the operation of the shutter 23 smooth to eliminate undesirable effects on the images. In color printing, a plurality of recording heads 1 are disposed in the direction of conveying the image support 6, and raising of the image support 6 relative to the conveying direction can be prevented by the spacers 5.

Further in the constitution shown in FIG. 1, a mechanism for applying a solidifying solution to promote the fixing of the recording solution is disposed additionally. The solidifying solution tank 11 stores a solidifying solution. The solidifying solution application roll 12 supplies the solidifying solution from the solidifying tank 11 by way of the film pressure control blade 13 to the image support 6. After applying the solidifying solution, the solidifying solution remaining on the solidifying solution application roll 12 is scraped off by the solidifying solution scraping member 14. The mechanism for applying the solidifying solution may be omitted depending on the case.

The outline of the operation in one embodiment of the image forming apparatus according to the present invention will be explained. The conveyor belt 7 is driven by the belt conveyor roll 8 and the image support 6 is sent to the recording head 1. The control section 4 intakes image information, controls the shutter driving section 3 in accordance with the image information to form images with the recording solution on the image support 6.

FIG. 5 is a schematic view illustrating an example of the operation upon forming a dot in the embodiment of the image forming apparatus according to the present invention. As described above, the recording solution in the recording solution chamber 21 of each of the recording heads 1 is always pressurized by the pressurizing member 24. However, since the shutter 23 is closed to block the extrusion opening 22 as shown in FIG. 5(A) when recording is not conducted, the recording solution does not flow out of the extrusion opening 22 but is kept as it is. Further, the shutter 23 blocks the extrusion opening 22 to prevent drying up of the recording solution in the recording solution chamber 21 thereby preventing trouble such as clogging of a solidified recording solution in the extrusion opening 22.

Figure 5A:
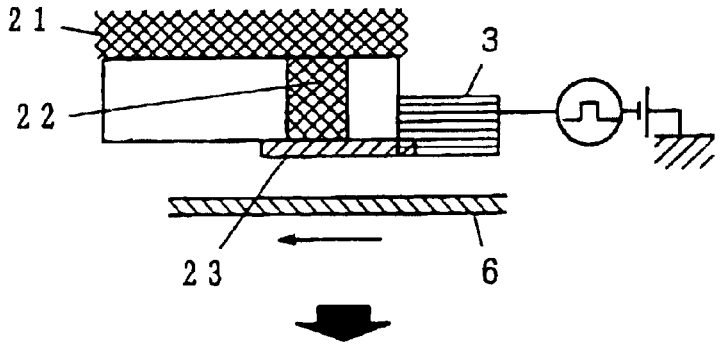
Figure 5B:
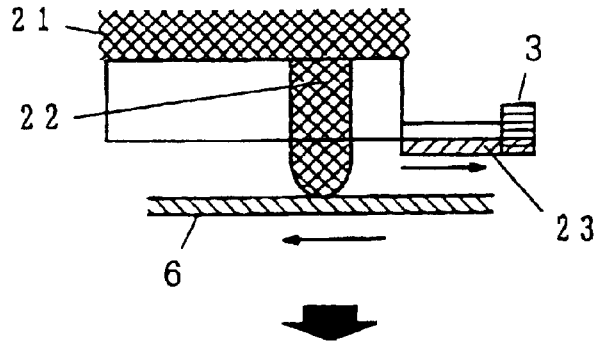

When a dot is formed by the recording solution in accordance with the image information on the image support 6, the control section 4 controls the shutter driving section 3 to drive the shutter 23. Then, the shutter 23 is opened as shown in FIG. 5(B), by which the extrusion opening 22 is opened. Since the recording solution is pressurized by the pressurizing member 24 as described above, the recording solution is extruded out of the opening 22 by the opening of the shutter 23. After the top end of a meniscus of the extruded recording solution is deposited to the opposing image support 6 or at the instance a predetermined amount of the recording solution flows out, the control section 4 controls the shutter driving section 3 to drive the shutter 23 and closes the extrusion opening 22 by the shutter 23. Since the pressurization to the recording solution is not stopped in this constitution, flow of the recording solution from the extrusion opening 22 is not stopped if the extrusion opening 22 is left open. Therefore, flow out of the recording solution is stopped by closing the shutter 23. Such a constitution also makes the structure extremely simple since it is not necessary to control the pressurizing force to the recording solution.

Figure 5C:
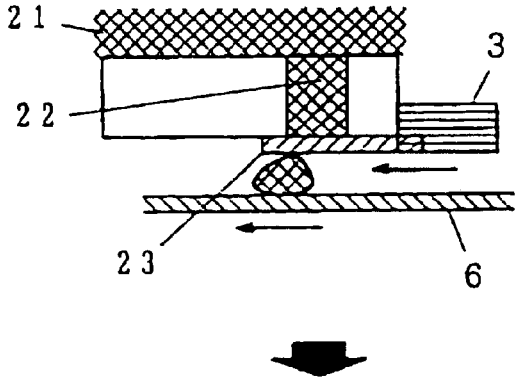
Figure 5D:
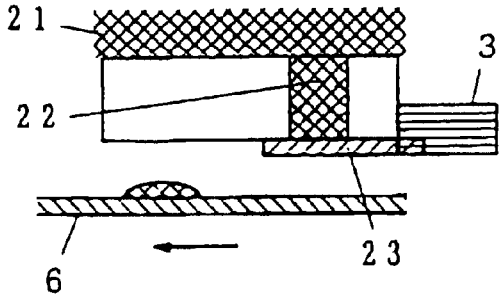

Further, when the shutter 23 is closed, the recording solution under flowing continuously out of the extrusion opening 22 is separated by the shutter 23. The recording is in contact with the image support 6 and causes adhesion to the image support 6, and a recording solution droplet is formed with the separated recording solution on the image support 6. As shown in FIG. 5(C), only the recording solution extruded so far from the extrusion opening 22 is deposited on the image support 6 to form a dot with the recording solution on the image support 6 as shown in FIG. 5(D). Since the recording solution is separated by the shutter 23, the recording solution does not cause stringing and a dot of a preferable shape is formed on the image support 6.

The formation of the dot as described above is conducted at each of the extrusion openings 22 in accordance with the image information. Further, the dot is formed as described above during movement of the image support 6 together with the conveyor belt 7 and a two-dimensional image is formed on the image support 6. Further, when images are formed in this manner by respective recording heads 1, color images are formed on the image support 6.

The image support 6 formed with the dot is conveyed further by the conveyor belt 7. The dot formed with the recording solution on the image support 6 sometimes requires a long time till the recording solution is dried if a recording solution used has a high viscosity or if the image support 6 has a poor hygroscopic property. In order to eliminate such drawbacks and conduct recording at high speed, a mechanism for applying a solidifying solution is disposed in the advancing direction of the image support 6. A solidifying solution is supplied from the solidifying solution tank 11 to the surface of the solidifying solution application roll 12, and controlled to a uniform thickness by the film pressure control blade 13. Then, the solidifying solution application roll 12 is brought into contact with the surface of the image support 6 to apply the solidifying solution uniformly on the surface of the image support 6 on which the dot is formed. The recording solution on the image support 6 solidifies instantaneously upon contact with the solidifying solution and is fixed on the image support 6. Therefore, since a recording operation can be conducted without waiting for the drying of the recording solution, a high speed recording operation is enabled.

Then, explanations will be made more specifically to the constitution for each of the portions in the embodiment of the image forming apparatus according to the present invention described above while also referring to concrete examples. At first, supply of the recording solution is to be explained. As described above, for extruding the recording solution out of the extrusion opening 22, the recording solution in the recording solution chamber 21 is always pressurized by predetermined pressurizing force of the pressurizing member 24. The pressurizing mechanism in this embodiment is adapted to drive a shaft 25 linearly by the rotation of the motor 2 and transmit the pressurizing force by the shaft 25 to the pressurizing member 24. This makes it possible to extrude the recording solution of high viscosity reliably from the extrusion opening 22. As an actual example of the motor 2, a small-sized motor manufactured by HONDA ELECTRONICS CO., LTD. (EF300/MMF2.8) is used, which can be driven at a resolution power of 64 D (decimal) with 5 V of remote voltage under a driving voltage of DC 40V.

The rotation time of the motor 2 is controlled by the image information to be recorded. Namely, since the consumption amount of the recording solution is different depending on the printed image and the density, it is necessary to drive the motor 2 in accordance with the consumption amount of the recording solution. As an example, several patterns for the driving time are previously set in accordance with the image density and the motor 2 can be driven by the selection of the pattern in this embodiment. FIG. 6 is a graph illustrating an example of a relationship between the pattern of the printed image density and the driving time of the motor 2. For example, five types of patterns are provided, namely, a pattern 5 having an image density of 80 to 100%, a pattern 4 having an image density of 79 to 60%, a pattern 3 having an image density of 59 to 40%, a pattern 2 having an image density of 39 to 15%, and a pattern 1 having an image density of 14 to 1%. Then as shown in FIG. 5, respectively, the driving time for the motor 2 is set such that the driving time for the motor 2 is longer for the pattern having higher image density. At the time of recording, an image density is determined from the input image information, a pattern is selected in accordance with the image density and the motor 2 may be driven by the corresponding driving time. This can pressurize the recording solution in the recording solution chamber 21 in accordance with the consumption amount of the recording solution, making it possible to control the pressure in the recording solution chamber 21. It may be apparent that various control methods can be adopted, for example, such that the consumption amount of the recording solution is detected and pulses corresponding to the consumption amount are given to the motor 2.

The pressurizing force of the pressurizing member 24 obtained by the rotation of the motor 2 may be relatively small. This is attained by making the cross sectional area of the recording solution chamber 21 large immediately before the extrusion opening 22, and making the length of the extrusion opening 22 having a small cross sectional area as short as possible as described previously. FIG. 7 is a graph illustrating an example of a relationship between the viscosity of the recording solution and required pressure. In FIG. 7, point a indicated by a blank circle shows a case of using the system according to the present invention, whereas points b–d indicated by solid circles show a case of flying the recording solution from the nozzle like that in the existent ink jet system. The energy for jetting the recording solution is compared here experimentally with respect to the pressure by air. Since a recording solution at low viscosity is used, the energy for flying the recording solution is small in the existent ink jet system. However, when a recording solution at a viscosity of about 2000 mPa·s as used in the present invention is employed, extremely large energy is required as shown in FIG. 7. In the present invention, the recording solution can be extruded with small energy about equal with that in the existent ink jet system even in a case of using a recording solution of high viscosity. Namely, in the present invention, a recording solution of high viscosity can be used with the energy identical with that in the prior art by adopting the constitution as described above.

Then, the structure near the extrusion opening 22 from which the recording solution is extruded will be explained. As described above, the extrusion opening 22 is disposed such that the distance from the recording solution chamber 21 to the opening end is short so as to reduce the wall resistance. Further, guide rails 26 are also disposed near the extrusion opening 22 for moving the shutter 23. In order to form a fine structure as the guide rails 26 and in order to prevent the lowering of the strength caused by reducing the length of the extrusion opening 22, a stainless steel material of high fabrication accuracy can be used, for example, as a member for forming the extrusion opening 22.

FIG. 8 is an explanatory view illustrating a problem caused by wetting near the extrusion opening 22. If the extrusion opening 22 is used being constitution merely as a through hole, it sometimes results in a problem that a recording solution spreads to the periphery of the opening end of the extrusion opening 22 immediately after the extrusion of the recording solution. This phenomenon is attributable to the wetting at the periphery of the opening end of the extrusion opening 22. By previously applying water repellent treatment to the periphery of the opening end, spreading of the recording solution to the periphery can be prevented as shown in FIG. 8(B). As the water repellent treatment, a less wetting material such as silicon oil may be coated on the surface, or fluoric treatment may be applied to the surface. Other appropriate methods may of course be used.

The dot diameter of the recording solution formed on the image support 6 can be controlled by the bore diameter of the extrusion opening 22. FIG. 9B is a graph illustrating an example of a relationship between the bore diameter of the extrusion opening and the dot diameter formed on the image support. In this example, the outer diameter of dots formed on the image support 6 is measured while varying the bore diameter a of the extrusion opening 22 shown in FIG. 9(A) from 50 μm to 180 μm. In this example, J paper (common paper) manufactured by Fuji Xerox Co., Ltd. is used for the image support 6 and the thickness b of the shutter 23 is set to 15 μm and the gap between the shutter 23 and the image support 6 is fixed to 40 μm in FIG. 9(A). A stainless steel material is used for the shutter 23, a piezoelectric element is used for the shutter driving section 3 and only one pulse is applied at 150 V for the driving voltage. Further, a recording solution having a viscosity of 1700 mPa·s is used as the recording solution.

In FIG. 9, it is aimed that the dot diameter formed on the image support 6 and the bore diameter of the opening 22 are identical and this is shown by a broken line. Further, the aimed value for the scattering of the diameter of dots formed on the image support 6 is provisionally set to ±10%, which is shown by hatched lines. The aimed value for the scattering is substantially equal with the scattering in the existent ink jet system.

As can be seen from FIG. 9, if the bore diameter of the extrusion opening 22 is 100 μm or less, the dot diameter formed on the image support 6 substantially satisfies the aimed value for the scattering and it is substantially of the same size as the bore diameter of the extrusion opening 22 if the diameter is 50 μm or less. For instance, since the pitch is 70.5 μm in the case of disposing the extrusion opening 22 at a density of 360 dpi as described above, the bore diameter of the extrusion opening 22 is made smaller than that. Within this range, the dot diameter formed on the image support 6 can be controlled satisfactorily by the bore diameter of the extrusion opening 22. Further, the constitution that the dot diameter formed on the image support 6 is substantially identical with the bore diameter of the extrusion opening 22 shows that the recording dot diameter can be controlled extremely easily as compared with the existent ink jet system in which the recorded dot diameter spreads nearly twice as large as the nozzle diameter. As described above, the image forming apparatus according to the present invention is suitable to the reduction of the dot diameter formed on the image support 6.

FIG. 10 is a graph illustrating an example of a relationship between the viscosity of a recording solution to be used and the diameter of dots to be formed. In the previous example, the bore diameter of the extrusion opening 22 is varied, whereas the viscosity of the recording solution is varied while fixing the bore diameter of the extrusion opening 22 constant in this experiment. The relationship is studied here to a case where the extrusion opening 22 has the bore diameters of 49 μm and 100 μm. Other conditions are identical with those in FIG. 9. It is aimed that the diameter of the dots formed on the image support 6 and the bore opening diameter of the extrusion opening 22 are identical.

As can be seen from FIG. 10, in the recording solution having a viscosity of about 1 mPa·s used in the existent ink jet system, blot occurred instantaneously upon contact of the meniscus of the recording solution on the image support 6, and the dot diameter was enlarged to about 250 $\mu$m to greatly deviate from the aimed value. Such a phenomenon occurred for the recording solution of a viscosity of 10 mPa·s. However, for the recording solution at a high viscosity, for example, 1 Pa·s to 100 Pa·s, a dot diameter approximate to the aimed value was obtained in any of the cases. A recording solution having a viscosity higher than 1000 Pa·s could not be used since the viscosity is excessively high and the feeding speed is retarded to make the recording dot scratchy.

As described above in the present invention, a recording solution having a viscosity within a wide range from 10 mPa·s to 1000 Pa·s can be used. Since the use of a recording solution of such high viscosity is enabled, it is possible to decrease feathering or bleeding due to blot or the like on the image support 6 to obtain an image of high quality. Further, since the range for the usable viscosity is wide, the degree of freedom for the selection of the recording solution is improved.

Then, the shutter 23 disposed to the extrusion opening 22 will be explained. As described above, the function required for the shutter 23 is to ensure the air tightness of the extrusion opening 22 and discontinue the recording solution of high viscosity. When the recording solution of high viscosity is discontinued, it is particularly important that the recording solution is not deposited on the shutter 23. For this purpose, a shutter 23 comprised, for example, of a stainless steel material applied with fluoric treatment on the surface can be used. As will be described later, since the driving speed of the shutter 23 has influence over the deposition of the recording solution upon discontinuation of the recording solution, the constitution of not depositing the recording solution provides a remarkable effect for the prevention of deposition during stoppage of the printing.

A guide plate is disposed to the shutter 23, and the guide plate engages the guide rails 26 as shown in FIG. 3 and moves along the guide rails 26. In this case, when the engaging portion of the guide plate with the guide rails 26 is formed into a T-shaped or L-shaped configuration, for example, as shown in FIG. 3, it can cope with the pressurizing force of the recording solution upon closure of the shutter 23 and ensure the air tightness to prevent the drying up of the recording solution per se.

Then, the mechanism of the shutter driving section 3 for driving the shutter 23 will be explained. As an element for driving the shutter 23 by the shutter driving section 3, an electric/vibration conversion element can be used and, for example, a lamination type piezoelectric element can be used. The lamination type piezoelectric element has a feature in that the displacement amount per unit volume is as large as 100 N·m per 10 $cm^3$ and can obtain a large displacement amount. Further, in the lamination type piezoelectric element, since each element is laminated in series, the driving energy loss is small and the torque is high, the flowing amount of recording droplets of high viscosity can be controlled easily. The structure of the piezoelectric element is, generally, a lamination type but it also includes n type and the like. Both of the structures are applicable to the present invention but the n type is more suitable for increasing the displacement amount. The frequency response of the shutter 23 can also be set higher by the use of the piezoelectric element and increase of the continuous driving frequency enables high speed printing.

As a specific example of an element to be used in the shutter driving section 3, type 90A manufactured by Sumitomo Metal Industries, Ltd. as serial lamination type piezoelectric element can be used, in view of the structure of the recording head 1. It has a structure having ceramic portions on both ends and can be applied with a voltage up to 300 V. Further, the maximum displacement amount upon applying the maximum voltage is 90 $\mu$m. With no particular restriction to the electric/vibration conversion element described above, any optional device may be used for the shutter driving section 3, so long as it can basically attain the same extent of displacement as the diameter of the recording dot to be printed as a displacement amount and can extend the response frequency to a range from 1 kHz to 50 or 100 kHz.

Then, driving speed of the shutter 23 driven by the shutter driving section 3 is to be explained. FIG. 11 is an explanatory view for an example of a relationship between the shutter driving speed and the aspect ratio of the recorded dot diameter. As in FIG. 9 described above, the thickness b of the at shutter 23 shown in FIG. 9(A) was set to 15 $\mu$m and a gap c between the shutter 23 and the paper sheet was fixed to 40 $\mu$m. Further, a recording solution at a viscosity of 1700 mPa·s was used. The aspect ratio of the dot diameter recorded on the image support 6 was defined as V/H assuming the dot diameter in the moving direction of the shutter 23 as V and the diameter of the dot in a direction perpendicular to the moving direction as H as shown in FIG. 11(A).

It has been found, as shown in FIG. 11, (B), that the driving speed of the shutter 23 gives an effect on the dot diameter to be recorded and if the driving speed of the shutter 23 is slower than 100 mm/sec, the aspect ratio of the recording dot is increase to 1.0 or more and the shape of the recording dot is extended in the driving direction of the shutter 23. Further, if the driving speed of the shutter 23 is 100 mm/sec or higher, the aspect ratio of the recording dot is about 1.0, so that it can be seen that the shape of the recording dot is kept substantially in a circular shape. Further, in driving speed region higher than that described above, if the recording solution of high viscosity is discontinued by the shutter 23, the recording droplets no more adhere to the shutter 23. That is, when the shutter 23 is driven by the shutter driving section 3 at a speed higher than 100 mm/sec, the droplets do not adhere to the shutter 23 and the recording dot is substantially of a circular shape. Further, since the recording solution is separated satisfactorily by the shutter 23, stringing can be prevented. It is effective in this case to apply a surface treatment for improving the releasability on the surface of the shutter 23, the driving speed of the shutter 23 (discontinuing speed for the droplets) of the shutter 23 is predominant with regard to the deposition of the recording solution during recording.

A fixing mechanism for the recording solution using a solidifying solution will be explained. It is also necessary to formulate the recording solution such that the recording solution is solidified in contact with the solidifying solution. In this case, a polysaccharide polymer is incorporated in the recording solution. An aqueous solution of a metal salt is used as the solidifying solution and the solidifying solution is deposited to the dot of the recording solution formed on the image support 6. A metal salt dissolved in water instantaneously possesses water as the solvent to cause gelation while diffusing into the polysaccharide polymer dissolved in water, to fix the dot on the image support 6.

Preferred polysaccharide polymer to be contained in the recording solution is, for example, align or alginic acid, or monovalent metal salt of alginic acid or carrageenan. Alginic acid is a natural polysaccharide polymer extracted from brown algae and contained in "wakame" seaweed or kelp. Alginic acid is mainly used in the form of a sodium salt as a water soluble thickener or viscosity improver in the fields of foodstuffs, medicines and cosmetics, or used variously as jelly with addition of calcium or as enzyme immobilizing beads. The structure of sodium alginate is of a sodium salt comprising a polymer of β-1, 4-D-mannuronic acid (M) and α-1, 4-L-gluconic acid (G). Sodium alginate forms a chelate together with a polyvalent metal salt such as of calcium and intakes water to be gelled. When they are chained into a polymer, gel forming performance is remarkably different depending on the ratio of GM, MM and GG. In the GG cluster region, molecules are bent into which calcium ions as one of ingredients of the solidifying solution intrude to make an egg box type structure to form a firm polymer. The thus formed gel is improved with the film forming performance as the molecular weight of alginic acid is increased, to form a film not soluble to water or oil. Suitable molecular weight is 10,000 or more, preferably, 50,000 or more.

Further, carrageenan is seaweed polysaccharides extracted from red algae. The chemical structure of carrageenan is a linear polymer having a molecular weight in the order from several hundred thousands to several millions and comprise D-galactose, 3,6-anhydro D-galactose and sulfate groups. They include three types of κ, λ and ι depending on the content of the sulfate groups. κ-type is preferred in view of high dynamic strength of the gel to be formed. This is gelled instantaneously in the presence of monovalent or polyvalent cationic ions such as of potassium or cesium as one of ingredients of the other solidifying solution. Carrageenan has a helical structure in the molecular chain. It is considered that the portion of the helical structure is coagulated by way of cationic ions to form a gel.

Since the gel thus formed possesses water, when paper is used, for example, as the image support 6, waving or curling of paper due to water transferred into fibers of paper can be prevented. Further, since the aqueous solution of the polysaccharide is viscous, it neither penetrates along the fibers of paper to result in feathering nor causes color mixing such as bleeding due to coupling between each of the droplets or blot. Furthermore, since the solidified polysaccharide polymer has high waterproofness and heat resistance, the recorded dot is stabilized on the image support 6.

Referring specifically to the recording solution, a black recording solution was prepared by dispersing 1.5 wt % of special black Bayer-A-SF (manufactured by Bayer Ltd.) and 0.1 wt % of sodium sulfonate-formalin condensation product into ion exchange water and, successively, adding to disperse 5 wt % of sodium alginate having a molecular weight of 80,000 (manufactured by Wako Pure Chemical Industries, Ltd.). This is a viscous liquid having a viscosity at 1800 mPa·s. Further, as a solidifying solution, an aqueous 10% solution of calcium chloride (pH 7.8) was prepared.

FIG. 12 is an explanatory view for an example of a fixing process of recording droplets in the fixing mechanism. In the drawing are shown recording droplets 31 and gelled recording droplets 32. In the example of the fixing mechanism shown in FIG. 1 and FIG. 12, at least the surface of the solidifying liquid application roll 12 is constituted such that it can possess the solidifying solution, and the solidifying solution in the solidifying solution tank 11 is possessed and supplied to the image support 6. For example, the surface of the solidifying solution application roll 12 can be constituted with a foamed sponge and the sponge can be impregnated with and possess the solidifying solution by immersing the sponge in the solidifying solution tank 11. In this state, the solidifying solution application roll 12 is rotated as it is and brought into contact with or somewhat pressurized to the image support 6, by which the solidifying solution can be coated on the image support 6. This is one of the methods that can be taken since the viscosity of the solidifying solution is lower as compared with the recording solution.

Alternatively, the surface of the solidifying solution application roll 12 may be formed with a material having an affinity with the solidifying solution, the solidifying solution is possessed on the solidifying solution application roll 12 in the solidifying solution tank 11 and then the film thickness of the solidifying solution is controlled by a film thickness control blade 13 and then the solution can be coated on the image support 6. Specifically, a roll coated, for example, with a silicone rubber may be used. In this case, the solidifying solution may be viscous.

As shown in FIG. 12(A), when the image support 6 is conveyed in a state where recording droplets 31 are formed by the recording head 1 on the image support 6, a solidifying solution is coated on the image support 6 by the solidifying solution application roll 12 possessing the solidifying solution as shown in FIG. 12(B). The recording droplets 31 are gelled instantaneously by the coating of the solidifying solution, and the gelled recording droplets 32 are secured firmly on the image support 6. In this way, an image with the gelled recording droplets 32 is formed on the image support 6 as shown in FIG. 12(C). In this case, no energy is required for the fixing, and images with neither deviation nor blot of the recording dot can be obtained at high speed.

EXAMPLE

For confirming the printability of the image forming apparatus according to the present invention described above, a print test was conducted. The apparatus used had a constitution shown in FIG. 1 to FIG. 4 in which the materials for the recording head 1 are made of an urethane resin for the recording solution chamber 21 and stainless steel for the portion forming the extrusion opening 2. The length of the extrusion opening 2 in the direction of arrangement was 212 mm. The diameter for the extrusion opening 2 was 70.5 μm. A lamination type piezoelectric element (type 90A, manufactured by Sumitomo Metal Industries, Ltd.) was used as the shutter driving section 3 and the shutter driving speed was set to 200 mm/sec. The feeding speed of the image support 6 was set to 150 mm/sec.

In this example, images were fixed by using a solidifying solution, and 1.5 wt % of special black Bayer-A-SF was used as a black recording solution in which 5 wt % of sodium alginate was dispersed. An aqueous 10% solution of calcium chloride (pH 7.8) i was used for the solidifying solution. An aluminum material of 10 mmϕ coated with silicone rubber having a rubber hardness of about 5 to 7 was used as the solidifying solution application roll 12. Silicone rubber of 1 mm in thickness was used as the film thickness control blade 13.

When the print test was practiced under the conditions described above, high quality images with no blot were obtained, without resulting in trouble such as stringing of the recording solution, rubbing by the recording head and, further, scattering of recording dots that were caused upon flying of the recording solution as the problems in the prior art. Further, the recording speed was sufficiently high.

Then, only the recording solution was replaced with no change for the printing mechanisms described above. A black recording solution was prepared by dispersing 1.5 wt % of special black Bayer-A-SF and 0.1 wt % of sodium sulfonate-formalin condensation product into ion exchanged water and then 2 wt % of carrageenan having a molecular weight of 800,000 (manufactured by Wako Pure Chemical Industries, Ltd.) was added and dispersed. The solidifying solution was the same aqueous solution of calcium chloride as described above. Using J paper (common paper) of Fuji Xerox Co., Ltd. as the image support 6 and, after printing, the solidifying solution was applied to obtain a recording product. Also in this case, high quality images with no blot could be obtained at high speed.

Further, as recording solutions of colors other than black, a cyan recording solution, a magenta recording solution and a yellow recording solution were prepared by replacing the special black Bayer-A-SF with acid blue 9, direct red 227 and direct yellow 87, respectively. After printing the color recording solutions and the black recording solution on the image support 6 in the order as shown in FIG. 1, an aqueous solution of calcium chloride was coated as a solidifying solution by the fixing mechanism to obtain a recording product in which color image constituents are fixed. Also in this case, high quality images with no blot were obtained at high speed as a result of the printing test.

The present invention is applicable to various image forming apparatuses such as copying machines, printers, word processors, plotters, facsimiles, and printing machines.

As apparent from the foregoing explanations, according to the present invention, since a recording solution of higher viscosity than that of the recording solution used in the existent ink jet system can be used, blot such as feathering or bleeding can be reduced, and recorded images at high quality can be obtained with no stringing that would occur upon deposition of highly viscous recording solution on the image support or scratches caused by the recording head. Further, the range for the usable viscosity of the recording solution is wide, and the range of the usable recording solution can be extended. Further, since the recording droplets are not caused to fly as in the existent ink jet system, the energy required for recording can be saved and the recording dot can be formed exactly. Furthermore, the response time from the extraction of the recording solution through the extrusion opening by the pressurizing force to arrival at the image support is shortened, so that high speed recording can be conducted. The present invention can provide various advantageous effects as described above.

What is claimed is:

1. An image forming apparatus comprising a recording solution chamber for possessing a recording solution, a pressurizing unit for pressurizing the recording solution in said recording solution chamber, an extrusion opening disposed to said recording solution chamber, a physical shutter disposed to said extrusion opening, and a shutter driving unit for driving to open and close said physical shutter in accordance with image information.

2. The image forming apparatus as defined in claim 1, wherein said extrusion opening is opposed at a predetermined distance to an image support on which an image is formed by the recording solution.

3. The image forming apparatus as defined in claim 2, wherein a spacer is disposed near the periphery of said extrusion opening for spacing apart said extrusion opening and the image support from each other by said predetermined distance, and said spacer and said image support are disposed so as to be in contact with each other.

4. The image forming apparatus as defined in claim 1, wherein said shutter driving unit is constituted by using an electric-vibration conversion element.

5. The image forming apparatus as defined in claim 1, wherein said shutter driving unit drives said physical shutter so as to open said extrusion opening in accordance with the image information and drives said physical shutter so as to close said extension opening after extrusion of a predetermined amount of the recording solution.

6. The image forming apparatus as defined in claim 1, wherein said shutter driving unit moves said physical shutter at a speed of 100 mm/sec or higher upon closure of said physical shutter.

7. The image forming apparatus as defined in claim 1, wherein the recording solution has a viscosity within a range from 10 mPa·s to 1000 pa·s, and contains at least one colorant.

8. The image forming apparatus as defined in claim 1, wherein said recording solution chamber provided with said extrusion opening, said pressurizing unit, said physical shutter and said shutter driving unit are disposed by a plurality of sets on each of a plurality of recording solutions.

9. The image forming apparatus as defined in claim 1, wherein a recording solution solidifying unit is further disposed for applying a solidifying solution for solidifying the recording solution to the recording solution on said image support.

10. The image forming apparatus as defined in claim 9, wherein said recording solution comprises at least a polysaccharide polymer.

11. The image forming apparatus as defined in claim 10, wherein said polysaccharide polymer comprises align, alginic acid, monovalent metal salt of alginic acid or carrageenan.

12. The image forming apparatus as defined in claim 9, wherein the solidifying solution is an aqueous solution of a metal salt.

13. The image forming apparatus of claim 1, wherein the physical shutter is associated with the extrusion opening at a periphery thereof where the recording solution exits towards an image support.

14. A method of forming an image in an image forming apparatus comprising a recording solution chamber for possessing a recording solution, an extrusion opening disposed to said recording solution chamber and a physical shutter disposed to said extrusion opening, said method further comprising the steps of:

pressurizing the recording solution in said recording solution chamber;

moving said physical shutter in accordance with a printing signal to open said extrusion opening;

extruding the recording solution in said recording solution chamber from said extrusion opening;

moving said physical shutter after deposition of the top end of the extruded recording solution to the image support; and thereby closing said extrusion opening and interrupting the extended recording solution.

15. The method of forming an image as described in claim 14, wherein a solidifying solution is further applied to the recording solution deposited to said image support.

16. The method of forming an image as described in claim 15, wherein the method comprises the steps of using a plurality of recording solutions, forming images by each of the recording solutions to said image support and, subsequently, applying said solidifying solution.

* * * * *